US006005541A

United States Patent [19]

Takahashi et al.

[11] Patent Number: 6,005,541

[45] Date of Patent: Dec. 21, 1999

[54] LIQUID CRYSTAL DISPLAY DISCHARGE CIRCUIT

[75] Inventors: Nobuaki Takahashi, Nara; Hideo Touge, Yamatokoriyama, both of Japan

[73] Assignee: Sharp Kabushiki Kaisha, Osaka, Japan

[21] Appl. No.: 08/815,703

[22] Filed: Mar. 12, 1997

[30] Foreign Application Priority Data

Mar. 21, 1996 [JP] Japan ..... 8-065013
Dec. 5, 1996 [JP] Japan ..... 8-325087

[51] Int. Cl.[6] ..... G09G 3/36

[52] U.S. Cl. ..... 345/87; 345/211

[58] Field of Search ..... 345/90, 87, 100, 345/904, 208, 66, 211, 212, 210, 88, 214, 215, 92

[56] References Cited

U.S. PATENT DOCUMENTS 5,572,735 11/1996 Tanikawa ..... 395/750.01
5,793,346 8/1998 Moon ..... 345/92

FOREIGN PATENT DOCUMENTS 59-46687 3/1984 Japan .

*Primary Examiner*—Richard A. Hjerpe
*Assistant Examiner*—Francis Nguyen
*Attorney, Agent, or Firm*—Nixon & Vanderhye P.C.

[57] ABSTRACT

A discharge circuit is connected to a bias voltage generating circuit and a liquid crystal driver. The discharge circuit includes a plurality of discharge transistors, wherein each bias voltage is connected to ground via a transistor. When a power of the apparatus is set in the ON state, the transistor is set OFF so that the bias voltage can be supplied only to the liquid crystal display panel without being supplied to the discharge circuit. On the other hand, when the power is set in the OFF state, the transistor is set ON so that a discharge occurs by moving charges stored on the liquid crystal display panel to the transistor. As a result, when the power is set in the ON state, a waste power consumption by members other than the liquid crystal display panel can be prevented, thereby achieving an apparatus of a low power consumption. Moreover, possible degradation due to charges of the liquid crystal display apparatus in its quality and appearance when the power of the apparatus is set in the OFF state can be prevented.

19 Claims, 14 Drawing Sheets

LIQUID CRYSTAL DISPLAY DISCHARGE CIRCUIT

FIELD OF THE INVENTION

The present invention relates to a liquid crystal display apparatus for use in OA (office Automation) apparatuses, AV (Audio Visual) apparatuses, etc. In particular, a display is performed by supplying a plurality of bias voltages to a liquid crystal display panel.

BACKGROUND OF THE INVENTION

FIG. 11 shows a schematic structure of a Super Twisted Nematic (STN) liquid crystal apparatus. As shown in the figure, the liquid crystal display apparatus includes a liquid crystal display panel 51, a segment driver 52, and a common driver 53. Although not shown, a plurality of scanning lines and signal lines are formed in the liquid crystal display panel 51. The segment driver 52 and the common driver 53 are drive circuits for supplying various signals (to be described later) to the liquid crystal display panel 51.

To the segment driver 52, a display data signal DATA and an input data shift clock XCK are respectively inputted via a buffer 54. To the common driver 53, a scanning start signal YD is inputted via the buffer 54. Further, an input data latch signal LP is inputted to the segment driver 52 and the common driver 53 via the buffer 54. A display control signal DISP is inputted via the buffer 54 to an alternating signal generating circuit 55 and a power sequence circuit 56.

The alternating signal generating circuit 55 generates an alternating signal M based on the display control signal DISP to be inputted thereto. The alternating signal M is inputted to the segment driver 52 and the common driver 53. The power sequence circuit 56 controls ON/OFF of the liquid crystal display panel 51 based on the display control signal DISP to be inputted thereto. The display control signal DISP outputted from the power sequence circuit 56 is respectively inputted to the segment driver 52, the common driver 53 and a DC/DC converter 57.

Other than the display control signal DISP, a logic source voltage $V_{dd}$, and a contrast adjusting voltage $V_{CON}$ are inputted to the DC/DC converter 57. Then, the DC/DC converter 57 outputs a bias reference voltage $V_{ee}$ to the bias voltage generating circuit 58. The bias voltage generating circuit 58 outputs bias voltages (intermediate voltage) $V_1$, $V_2$, . . . , $V_n$ based on the bias reference voltage $V_{ee}$ to the segment driver 52 and the common driver 53.

Namely, in the described liquid crystal display apparatus, various signals, clocks and bias voltages $V_1$, $V_2$, . . . $V_n$ are inputted to the segment driver 52 and the common driver 53. As a result, a scanning line of the liquid crystal display panel 51 is selected as desired, and a predetermined dot of the liquid crystal display panel 51 is lightened in response to the display data signal DATA.

In the described liquid crystal display apparatus, even when the power of the apparatus is set in the OFF state, or a display is prohibited, a DC voltage is still being applied to the liquid crystal display panel 51. This causes degradation of the liquid crystal display panel 51 in its quality and appearance. In order to prevent such problem, it is required to remove charges stored on the liquid crystal display panel 51 when the power of the apparatus is set in the OFF state, or a display is prohibited.

For the described purpose, the conventional liquid crystal display apparatus includes a discharge circuit 59 to remove charges stored on the liquid crystal display panel 51 when the power of the apparatus is set in the OFF state or a display is prohibited.

As shown in FIG. 12, the discharge circuit 59 is formed by discharge resistors $R_1$, $R_2$, . . . $R_n$. These discharge resistors $R_1$, $R_2$, . . . , $R_n$ are provided in parallel across respective bias voltages $V_1$, $V_2$, . . . $V_n$, outputted from the bias voltage generating circuit 58, and a $V_{ss}$ line (0 V). In the described arrangement, when the power of the apparatus is set in the OFF state, or a display is prohibited, charges on the liquid crystal display panel 51 are removed via the discharge resistors $R_1$, $R_2$, . . . , $R_n$ by discharge.

On the other hand, FIG. 13 shows a schematic structure of the liquid crystal display apparatus which is disclosed, for example, by Japanese Unexamined Patent Application No. 46687/1984 (Tokukaisho 59-46687). In this liquid crystal display apparatus, a bias supply circuit 61 is connected to the $V_{ss}$ line (0V) via switching elements such as field effect transistors $Q_1'$ and $Q_2'$. When an application of bias voltages is not needed such as in a display prohibit drive mode, etc., the field effect transistors $Q_1'$ and $Q_2'$ are set in the OFF state.

According to the described arrangement, when the application of the bias voltages is not needed, the field effect transistors $Q_1'$ and $Q_2'$ are set in the OFF state. Therefore, a current does not flow in the $V_{ss}$ line via bias voltage generation-use voltage dividing resistors $R_1'$ and $R_2'$. As a result, a waste power consumption in the bias voltage generation-use voltage dividing resistors $R_1'$ and $R_2'$ when an application of bias voltages is not needed can be avoided.

However, in the arrangement of the conventional liquid crystal display apparatus shown in FIG. 12, as bias voltages $V_1$, $V_2$, . . . , $V_n$ are always applied to the liquid crystal display panel 51 and peripheral circuits, while the bias voltages $V_2$, $V_2$, . . . , $V_n$ are being applied thereto, a current from the bias voltage generating circuit 58 flows also in the discharge resistors $R_1$, $R_2$, . . . $R_n$ that are respectively connected to the bias voltages $V_1$, $V_2$, . . . , $V_n$ in parallel. Therefore, in the conventional arrangement, when the power of the apparatus is set in the ON state, a power $P_R$ is wasted.

For example, a waste power consumption in the case of generating four bias voltages $V_1$, $V_2$, $V_3$ and $V_4$ as shown in FIG. 14 will be considered. Generally, the power $P_R$ to be consumed in the discharge resistors $R_1$, $R_2$, . . . $R_n$ are given by the following equation:

$$P_R = V_1^2 / R_1 + V_2^2 / R_2 + \ldots + V_n^2 / R_n$$

$$= \sum_{k=1}^{n} (V_k^2 / R_k).$$

Assumed that the bias reference voltage $V_{ee}$=30 V, then respective bias voltages $V_1$, $V_2$, $V_3$ and $V_4$ are respectively 28.125 V, 26.26 V, 3.75 V and 1.875 V, and the discharge resistors $R_1$, $R_2$, $R_3$ and $R_4$ are respectively 33 kΩ. From the above equation, the power $P_R$ to be consumed in the discharge resistors $R_1$, $R_2$, $R_3$ and $R_4$ is given as $P_R$=45.4 mW. Here, these numeral values correspond to around 5 to 6 percents of the power consumed when displaying an image. Therefore, while the bias voltages $V_1$, $V_2$, $V_3$ and $V_4$ are being applied, the power $P_R$ is always consumed in the discharge circuit 59.

According to the arrangement of the described Japanese publication shown in FIG. 13, when the power of the apparatus is set in the OFF state, the power to be consumed in the bias supply circuit 61 can be saved by setting the field effect transistors $Q_1'$ and $Q_2'$ in the OFF state. However, when the field effect transistors $Q_1'$ and $Q_2'$ are set in the OFF state, charges stored on the liquid crystal display panel 62 do not flow in the $V_{ss}$ line (0 V) via the field effect transistors $Q_1'$ and $Q_2'$. As a result, the charges stored on the liquid crystal display panel 62 are not removed, which results in degradation of the liquid crystal display panel 62 in its quality and appearance.

SUMMARY OF THE INVENTION

It is therefore an objective of the present invention to provide a liquid crystal display apparatus which permits a reduction in waste power consumption when a power of the apparatus is set in the ON state and prevents a liquid crystal display panel from being degraded in its quality and appearance by removing therefrom charges stored thereon when the power of the apparatus is set in the OFF state.

In order to achieve the object, the liquid crystal display apparatus in accordance with the present invention is characterized by including: a liquid crystal display panel; drive means for driving the liquid crystal display panel; bias voltage generation means for generating a plurality of bias voltages in accordance with display data, and for supplying the plurality of bias voltages to the drive means to perform a display on the liquid crystal display panel; and discharge means, connected to the drive means and to the bias voltage generation means, for removing charges supplied thereto by discharge, wherein the discharge means removes charges stored on the liquid crystal display panel by discharge when a power of the apparatus is set in the OFF state, or a display is prohibited, while the bias voltages are supplied only to the liquid crystal display panel when a display is permitted.

According to the described arrangement, when a display is permitted, a plurality of bias voltages are applied to a liquid crystal display panel according to the display data via the drive means from the bias voltage generation means. Here, the bias voltage is supplied only to the liquid crystal display panel by the function of the discharge means. Namely, when a display is permitted, the bias voltage is not supplied to members other than the liquid crystal display panel. As a result, waste power consumption by members other than the liquid crystal display panel can be prevented.

Conventionally, when a display is permitted, the bias voltages are applied also to the discharge means, and the power is wasted in the discharge means when a display is permitted. However, according to the described arrangement, when a display is permitted, the bias voltages are not supplied to members other than the liquid crystal display panel.

Therefore, the described arrangement offers a solution to the described problem associated with the conventional arrangement, i.e., a waste power consumption by members other than the liquid crystal display panel, thereby achieving an apparatus of a low power consumption.

On the other hand, when the power of the apparatus is set OFF, or a display is prohibited, charges stored on the liquid crystal display panel are discharged by the function of the discharge means. As a result, the liquid crystal display panel can be prevented from being degraded in its quality and appearance.

The discharge means is composed of a pair of switch means and a resistor provided corresponding to each bias voltage. In this case, each bias voltage is connected to ground via the corresponding switch means and the resistor.

In this case, for example, by switching OFF the switch means when a display is permitted, bias voltages are not supplied to the discharge means but only to the liquid crystal display panel. As a result, the power is not consumed in the discharge means when a display is permitted.

Additionally, for example, when the power is set OFF, or a display is prohibited, by switching ON the switch means, charges stored on the liquid crystal display panel flow in the resistor provided in the discharge means via the switch means. As a result, charges are removed from the resistor by discharge.

Therefore, the described arrangement reliably prevents the bias voltage from being supplied the discharge means by means of the switch means when a display is permitted, thereby achieving an apparatus of low power consumption. Moreover, in the state where the power is set OFF, and a display is prohibited, charges stored on the liquid crystal display panel are supplied to the discharge means by switch means and discharged. As a result, the liquid crystal display panel can be prevented from being degraded in its quality and appearance.

The discharge means is composed of, for example, the field effect transistors provided so as to correspond to respective bias voltages which may be connected to ground via the corresponding field effect transistors.

For example, the P-type field effect transistor has such characteristic that a drain current does not flow when a gate-source voltage becomes not less than a predetermined threshold value. Namely, in this state, the field effect transistor is set in the OFF state. On the other hand, when the gate-source voltage becomes not more than the predetermined threshold value, the field effect transistor has such characteristic that a drain current flows with a predetermined resistance. Namely, in this case, the field effect transistor is set in the ON state.

The field effect transistor is set in the OFF state when the power of the apparatus is set in the ON state; while it is set in the ON state with a predetermined resistance when the power of the apparatus is set in the OFF state. Namely, the field effect transistor serve both as the switch means and the resistor.

Therefore, according to the described arrangement, even if the discharge means is constituted by the field effect transistors, the described effects of the present invention that a waste power consumption which possibly occurs when the power of the apparatus is set in the OFF state can be prevented, and the liquid crystal display panel can be prevented from being degraded by removing charges stored on the liquid crystal display panel by discharge when the power of the apparatus is set in the OFF position.

Additionally, as the field effect transistor itself serves as the resistor, a need of additional resistor for use in discharge can be eliminated. As this permits a number of required members in the apparatus to be reduced, a liquid crystal display apparatus of a simplified structure can be achieved.

Here, instead of adopting the field effect transistors, bipolar transistors having the same characteristics as the field effect transistor may be equally adopted, and such transistor would offer the described effects of the present invention.

For a fuller understanding of the nature and advantages of the invention, reference should be made to the ensuing detailed description taken in conjunction with the accompanying drawings.

DETAILED DESCRIPTION OF THE EXEMPLARY EMBODIMENTS

Figure 1:
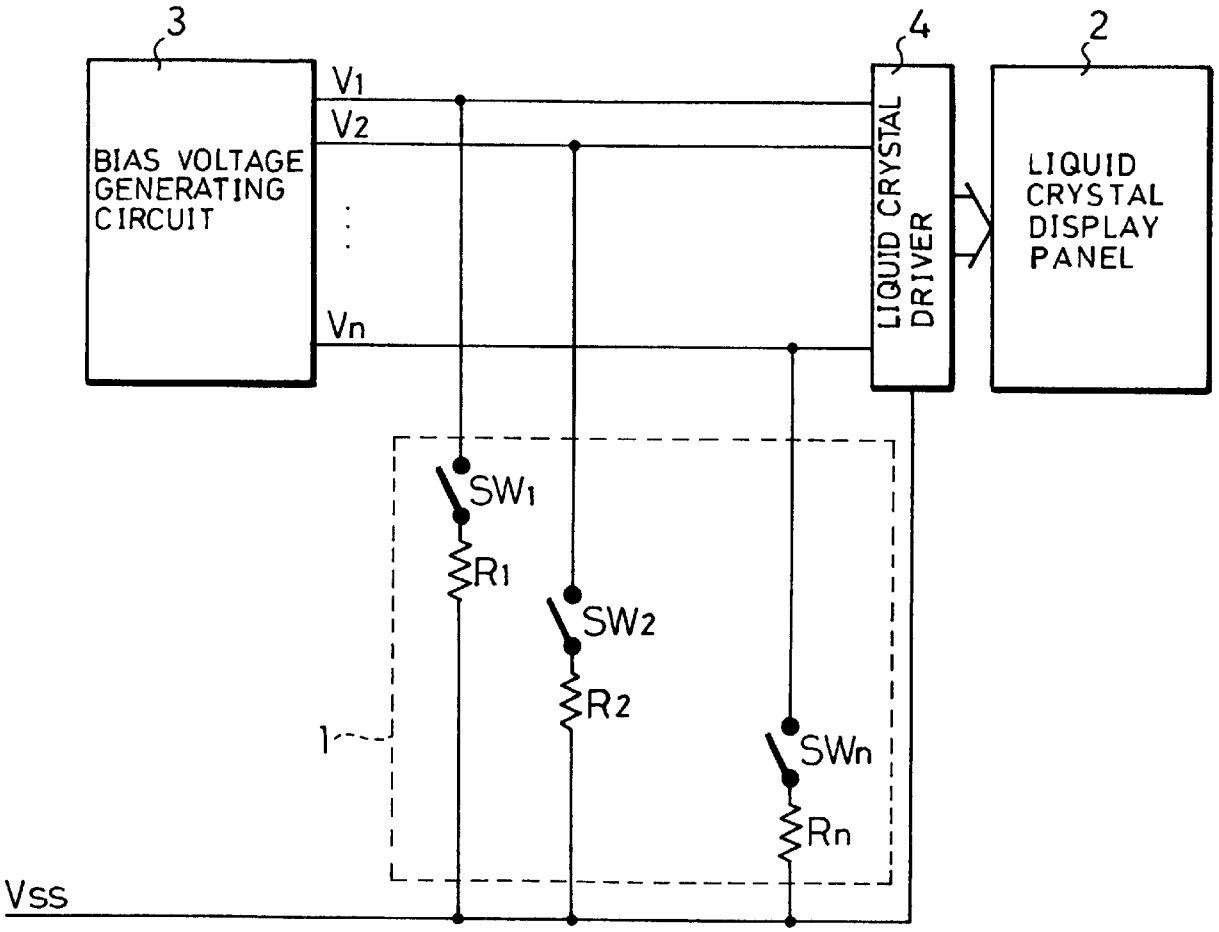
FIG. 1 is an explanatory view illustrating a structure of a discharge circuit provided in a liquid crystal display apparatus in accordance with the present invention.

The following descriptions will discuss a embodiment of the present invention in reference to FIG. 1. A liquid crystal display apparatus in accordance with the present invention has the same structure as the conventional liquid crystal display apparatus except for a discharge circuit 1. Thus, the descriptions of the members having the same function as those of the aforementioned conventional arrangement shall be omitted, and the explanations will be given mainly on the structure of the discharge circuit 1 and the operation of the apparatus.

As shown in FIG. 1, a liquid crystal display apparatus in accordance with the present invention includes a liquid crystal display panel 2, a bias voltage generating circuit 3, and a liquid crystal driver 4 for driving the liquid crystal display panel 2.

The liquid crystal display panel 2 is arranged such that a liquid crystal is sealed between a pair of transparent substrates, wherein a plurality of scanning lines and signal lines are formed on one of the transparent substrates. The bias voltage generating circuit 3 generates a plurality of bias voltages $V_1, V_2, \ldots V_n$ according to display data by dividing a predetermined reference voltage, and applies the plurality of bias voltages $V_1, V_2, \ldots V_n$ to the liquid crystal driver 4 to display the liquid crystal display panel 2.

The liquid crystal driver 4 is composed of a segment driver and a common driver. The segment driver selects the plurality of bias voltages $V_1, V_2, \ldots V_n$ from the bias voltage generating circuit 3 to be applied to the liquid crystal display panel 2. The common driver supplies a display drive signal of the voltage corresponding to the display data based on the bias voltages $V_1, V_2, \ldots V_n$ to the liquid crystal display panel 2. As a result, dots in the liquid crystal display panel 2, corresponding to the scanning line which undergoes an application of the bias voltages $V_1, V_2, \ldots V_n$ and the signal line which undergoes an application of a display drive signal, flash, thereby performing a display based on the display data.

To the bias voltage generating circuit 3 and the liquid crystal driver 4, a discharge circuit 1 for removing charges by discharge is connected. The discharge circuit 1 composed of a plurality of switches $SW_1, SW_2, \ldots SW_n$, and discharge resistors $R_1, R_2, \ldots R_n$. Then, a switch $SW_1$ and a resistor $R_1$, a switch $SW_2$ and a resistor $R_2$, and a switch $SW_n$ and a resistor $R_n$ are provided in pairs so as to correspond to the bias voltages $V_1, V_2, \ldots V_n$ respectively.

To be specific, switches $SW_1, SW_2 \ldots SW_n$ sides of the discharge circuit 1 are respectively connected to output terminals of the bias voltage generating circuit 3. On the other hand, the resistors $R_1, R_2, \ldots R_n$ sides of the discharge circuit 1 are connected to ground to be set in a ground potential $V_{ss}$ (0V). Namely, the bias voltages $V_1, V_2, \ldots V_n$ are connected to ground via switches $SW_1, SW_2, \ldots, SW_n$ and the resistors $R_1, R_2, \ldots R_n$. Additionally, the switches $SW_1, SW_2, \ldots SW_n$ are set OFF when the power of the apparatus is set in the ON state, while set ON when the power of the apparatus is set in the OFF state.

Next, an operation of the liquid crystal display apparatus of the present invention including the discharge circuit 1 will be explained in reference to figures.

In the described arrangement, when the power of the apparatus is set in the ON state, i.e., a display is permitted (normal display state), the bias voltage generating circuit 3 generates a plurality of bias voltages $V_1, V_2, \ldots V_n$. Then, the selected bias voltage and the display drive signal are applied to the liquid crystal display panel 2 via the scanning line and the signal line.

Here, when the power of the apparatus is set in the ON state, i.e., when a display is permitted, as respective switches $SW_1, SW_2, \ldots SW_n$ of the discharge circuit 1 are set in the OFF state, the bias voltages $V_1, V_2, \ldots V_n$ are not applied to the discharge circuit 1 but to the liquid crystal display panel 2 via the liquid crystal driver 4. Namely, in the state where a display is permitted, the bias voltages $V_1, V_2, \ldots V_n$ are not applied to the members other than the liquid crystal display panel 2.

On the other hand, when the power of the apparatus is set in the OFF state, i.e., when a display is prohibited, as the switches $SW_1, SW_2, \ldots SW_n$ are set in the ON state, charges stored on the liquid crystal display panel 2 flow in the resistors $R_1, R_2, \ldots R_n$ via the switches $SW_1, SW_2, \ldots SW_n$. As a result, charges are removed via the resistors $R_1, R_2, \ldots R_n$ by discharge.

As described, the liquid crystal display apparatus in accordance with the present invention includes the liquid crystal display panel 2, and the liquid crystal driver 4 for driving the liquid crystal display panel 2, wherein a plurality of bias voltages $V_1, V_2, \ldots V_n$ are applied to the liquid crystal driver 4 based on the display data so as to perform a display of the liquid crystal display panel 2. The liquid crystal display apparatus includes the discharge circuit 1 for removing charges from the liquid crystal display panel 2 by discharge when the apparatus is set in the OFF state, and the display is prohibited, while for supplying the bias voltages $V_1, V_2, \ldots V_n$ only to the liquid crystal display panel 2 when a display is permitted.

According to the described arrangement, when a display is permitted, a plurality of bias voltages $V_1, V_2, \ldots V_n$ are applied based on the display data to the liquid crystal display panel 2 via the liquid crystal driver 4. In this state, the bias voltages $V_1, V_2, \ldots V_n$ are applied only to the liquid crystal display panel 2 by the discharge circuit 1. Namely, the plurality of bias voltages $V_1, V_2, \ldots V_n$ are not applied to the members other than the liquid crystal display panel 2 when a display is permitted. As a result, a waste power consumption by the members other than the liquid crystal display panel 2 can be avoided.

For comparison, conventionally, respective bias voltages are also applied to the discharge circuit when a display is permitted. This causes a waste power consumption by the discharge circuit. In contrast, according to the described arrangement, the bias voltages $V_1, V_2, \ldots V_n$ are not applied to members other than the liquid crystal display panel 2 when a display is permitted.

Therefore, the described arrangement offers a solution to the problem associated with the conventional arrangement, i.e., the waste power consumption by members other than the liquid crystal display panel 2 when a display is permitted. As a result, a total power consumption by the apparatus as a whole can be reduced from around 5 to 6% of the power consumption in the conventional liquid crystal display apparatus, thereby providing a liquid crystal display apparatus of low power consumption.

On the other hand, when the power of the apparatus is set in the OFF state, or when a display is inhibited, charges stored on the liquid crystal display panel 2 are removed by discharge by the discharge circuit 1. As a result, the liquid crystal display panel 2 can be prevented from being degraded in its quality and appearance.

The liquid crystal display apparatus in accordance with the present invention is composed of switches $SW_1, SW_2, \ldots SW_n$ and the resistors $R_1$, $R_2$ and $R_n$ which form pairs respectively corresponding to the bias voltages $V_1, V_2, \ldots, V_n$, wherein respective bias voltages $V_1, V_2, \ldots V_n$ are connected to ground via the switches $SW_1, SW_2, \ldots SW_n$ and the resistors $R_1, R_2, R_n$.

According to the described arrangement, upon switching OFF the switches $SW_1, SW_2, \ldots SW_n$, the bias voltages $V_1, V_2, \ldots V_n$ are applied not to the discharge circuit 1 but only to the liquid crystal display panel 2. This prevents a waste power consumption by the discharge circuit 1 in a state where a display is permitted.

On the other hand, when the switches $SW_1, SW_2, \ldots SW_n$ are set ON in the state when the power is set in the OFF state, or a display is prohibited, charges stored on the liquid crystal display panel 2 flow in the resistors $R_1, R_2, \ldots R_n$ provided in the discharge circuit 1 via the switches $SW_1, SW_2, \ldots SW_n$. As a result, charges are removed by the resistors $R_1, R_2, \ldots R_n$ by discharge.

Therefore, according to the described arrangement, when a display is permitted, an application of respective bias voltages $V_1, V_2, \ldots V_n$ to the discharge circuit 1 can be surely prevented. As a result, when a display is permitted, respective bias voltages $V_1, V_2, \ldots V_n$ can be supplied only to the liquid crystal display panel 2. As a result, a waste power consumption of the members other than liquid crystal display panel 2 can be surely prevented, thereby providing a liquid crystal display apparatus which surely permits a reduction in power consumption.

When the power of the apparatus is set in the OFF state, and the display is prohibited, the charges stored on the liquid crystal display panel 2 can be supplied to the discharge circuit 1 for sure and discharged by the switches $SW_1, SW_2, \ldots SW_n$. As a result, the liquid crystal display panel 2 can be surely prevented from being degraded in its quality and appearance.

Another embodiment of the present invention will be explained in reference to FIG. 2 through FIG. 10. Here, members having the same function as those of the aforementioned embodiment will be designated by the same reference numerals, and thus the descriptions thereof shall be omitted here.

Figure 2:
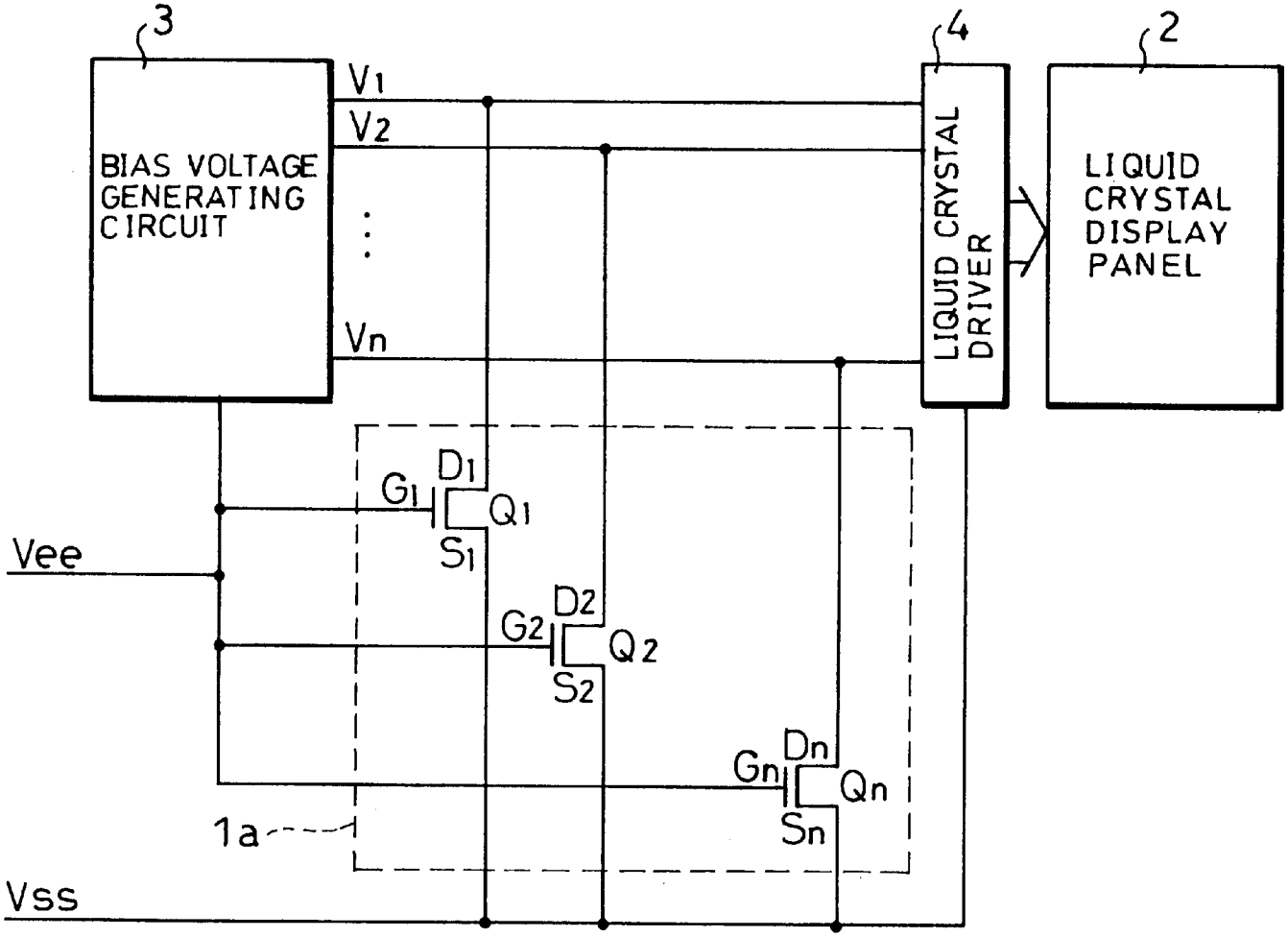
FIG. 2 is an explanatory view illustrating an arrangement where the discharge circuit is constituted by P-type field effect transistors, and a bias reference voltage is applied to a gate electrode of the field effect transistor.

FIG. 2 shows a schematic structure of a liquid crystal display apparatus in accordance with the present embodiment. According to the liquid crystal display apparatus, a discharge circuit 1a composed of P-type field effect transistors $Q_1, Q_2, \ldots Q_n$ is adopted in replace of the discharge circuit 1 (see FIG. 1) of the first embodiment which is constituted by respective pairs of the switch $SW_1$ and the resistor $R_1$, the switch $SW_2$ and the resistor $R_2$, . . . the switch $SW_n$ and the resistor $R_n$.

Drain electrodes $D_1, D_2, \ldots D_n$ of the P-type field effect transistors $Q_1, Q_2, \ldots Q_n$ are respectively connected to output terminals of the bias voltage generating circuit 3. Source electrodes $S_1, S_2, \ldots S_n$ are respectively connected the ground potential $V_{ss}$. The gate electrodes $G_1, G_2, \ldots G_n$ are respectively connected to the bias reference voltage $V_{ee}$ for generating the bias voltages $V_1, V_2, \ldots V_n$. The bias voltages $V_1, V_2, \ldots V_n$ are connected to ground via the P-type field effect transistors $Q_1, Q_2, \ldots Q_n$.

Figure 3:
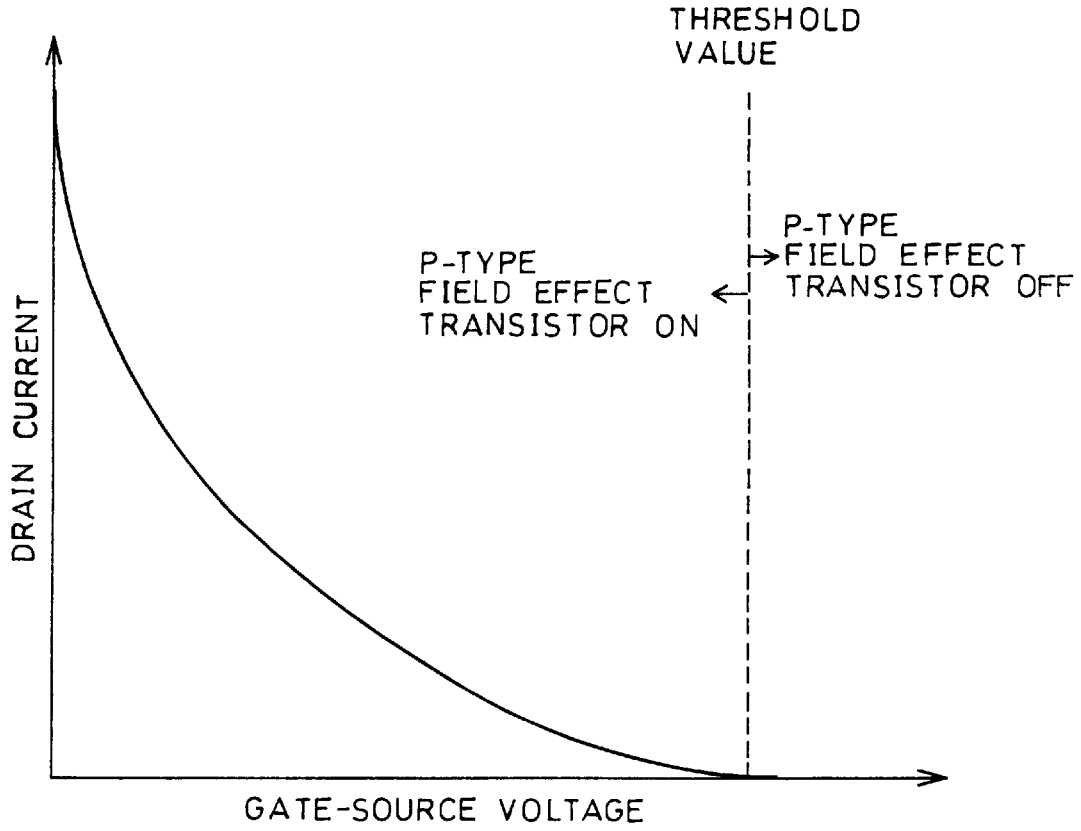
FIG. 3 is a graph showing a correlation between a gate-source voltage and a drain current of the P-type field effect transistor.

Here, FIG. 3 shows a correlation between the gate-source voltage and the drain current in the P-type field effect transistors $Q_1, Q_2, \ldots Q_n$. As can be seen from the figure, the P-type field effect transistors $Q_1, Q_2, \ldots Q_n$ have such characteristics that when a gate-source voltage becomes not less than a predetermined threshold value, a drain current does not flow. Namely, in this state, the P-type field effect transistors $Q_1, Q_2, \ldots Q_n$ are set in the OFF state. On the other hand, when a gate-source voltage is not more than a predetermined threshold value, a drain current flows in the P-type field effect transistors $Q_1, Q_2, \ldots Q_n$ with a predetermined resistor. Namely, P-type field effect transistors $Q_1, Q_2, \ldots Q_n$ are set in the ON state. In the present embodiment, the bias reference voltage $V_{ee}$ is set such that the gate-source voltage of the P-type field effect transistors $Q_1, Q_2, \ldots Q_n$ is greater than a predetermined threshold value.

In the described arrangement, as the above-defined bias reference voltage Vhd eeis applied to the gate electrodes $G_1, G_2, \ldots G_n$ respectively when the power of the apparatus is in the ON state, a gate-source voltage becomes greater than the threshold value, and the drain current does not flow by the described characteristics. As a result, the P-type field effect transistors $Q_1, Q_2, \ldots Q_n$ shown in FIG. 2 are set in the OFF state. Therefore, bias voltages $V_1, V_2, \ldots V_n$ from the bias voltage generating circuit 3 are applied only to the liquid crystal display panel 2 via the liquid crystal driver 4.

On the other hand, when the power of the apparatus is in the OFF state, as the bias reference voltage $V_{ee}$ is not applied to the gate electrodes $G_1, G_2, \ldots G_n$ respectively, a gate-source voltage becomes smaller than the predetermined threshold value, and the P-type field effect transistors $Q_1, Q_2, \ldots Q_n$ respectively have a predetermined resistor by the described characteristics, thereby setting the transistors $Q_1$, $Q_2$, . . . $Q_n$ in the ON state. As a result, when the power of the apparatus is set in the OFF state, in the described P-type field effect transistors $Q_1$, $Q_2$, . . . $Q_n$, charges stored on the liquid crystal display panel 2 are surely removed by discharge.

As described, the liquid crystal display apparatus in accordance with the present embodiment is arranged such that the discharge circuit 1*a* is composed of the P-type field effect transistors $Q_1$, $Q_2$, . . . $Q_n$ provided so as to correspond to the bias voltages $V_1$, $V_2$, . . . $V_n$ respectively, and the bias voltages $V_1$, $V_2$, . . . $V_n$ are connected to ground via the P-type field effect transistors $Q_1$, $Q_2$, . . . $Q_n$.

According to the described arrangement, when the power of the apparatus is set in the ON state, the P-type field effect transistors $Q_1$, $Q_2$, . . . $Q_n$ are set in the OFF state. On the other hand, when the power of the apparatus is set in the OFF state, the P-type field effect transistors $Q_1$, $Q_2$, . . . $Q_n$ themselves have resistors and are set in the ON state. Namely, the P-type field effect transistors $Q_1$, $Q_2$, . . . $Q_n$ serve both the switches $SW_1$, $SW_2$, . . . $SW_n$ and the resistors $R_1$, $R_2$ . . . $R_n$ adopted in the first embodiment.

Therefore, when the power of the apparatus is set in the ON state, the bias voltages $V_1$, $V_2$, . . . $V_n$ generated from the bias voltage generating circuit 3 can be surely applied only to the liquid crystal display panel 2. As a result, the problem of waste power consumption by members other than the liquid crystal display panel 2 can be prevented, thereby providing a liquid crystal display apparatus of low power consumption.

On the other hand, when the power of the apparatus is set in the OFF state, charges stored on the liquid crystal display panel 2 can be removed by discharge by the P-type field effect transistors $Q_1$, $Q_2$, . . . $Q_n$, thereby preventing the liquid crystal display panel 2 from being degraded in its quality and appearance.

Another beneficial feature that the discharge circuit 1*a* composed of the P-type field effect transistors $Q_1$, $Q_2$, . . . $Q_n$ serves as the discharge circuit 1 of the first embodiment eliminates a need of additional resistors for use in discharge. Namely, as the described arrangement permits a simplification of the structure by reducing a number of required members of the apparatus and a cost reduction of the liquid crystal display apparatus.

Furthermore, as the bias reference voltage $V_{ee}$ for generating the bias voltages $V_1$, $V_2$, . . . $V_n$ are applied to the gate electrodes $G_1$, $G_2$, . . . $G_n$ of the P-type field effect transistors $Q_1$, $Q_2$, . . . $Q_n$, the drain current as well as the voltage applied thereto can be adjusted.

Figure 4:
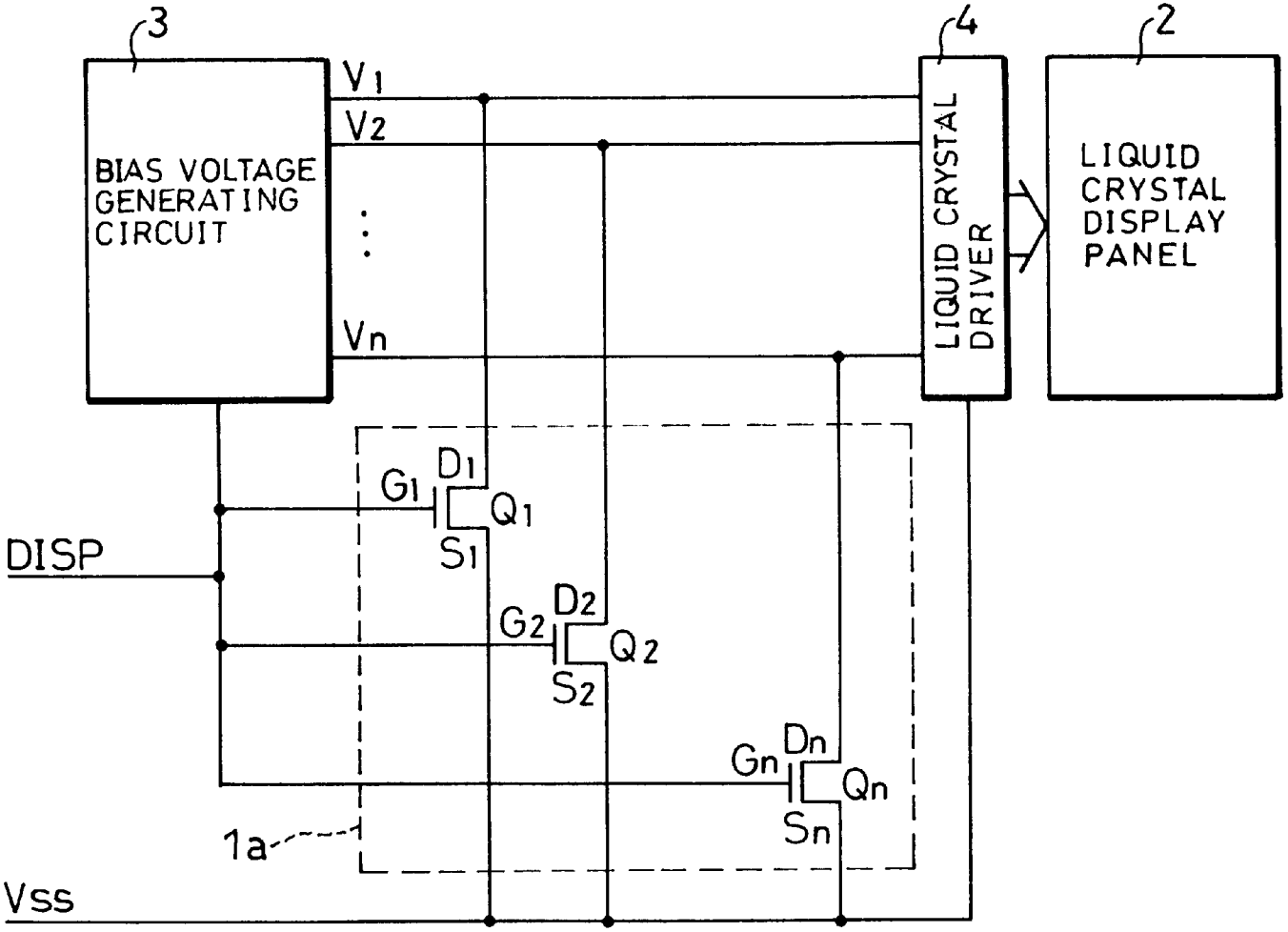
FIG. 4 is an explanatory view illustrating an arrangement where a display control signal is applied to a gate electrode of the P-type field effect transistor.

In the described embodiment, the arrangement wherein the bias reference voltage $V_{ee}$ is applied to respective gate electrodes $G_1$, $G_2$ . . . $G_n$ of the P-type field effect transistors $Q_1$, $Q_2$, . . . $Q_n$ is adopted. However, as shown in FIG. 4, the arrangement of applying the display control signal DISP to the respective gate electrodes $G_1$, $G_2$, . . . $G_n$ may be adopted, as such arrangement offers the same effect as achieved from the arrangement of the present embodiment by the characteristics of the P-type field effect transistors $Q_1$, $Q_2$, . . . $Q_n$.

Namely, the bias reference voltage $V_{ee}$ is outputted from a DC/DC converter (not shown) based on the ON/OFF control of the display control signal DISP. Therefore, the ON/OFF control of the display control signal DISP is consequently the same as the ON/OFF control of the bias reference voltage $V_{ee}$. Therefore, the same effect can be achieved also from the arrangement of applying the display control signal DISP to respective gate electrodes $G_1$, $G_2$, . . . $G_n$ of the P-type field effect transistors $Q_1$, $Q_2$, . . . $Q_n$. Therefore, the bias reference voltage $V_{ee}$ and the display control signal DISP, the one which can be applied to the gate electrodes $G_1$, $G_2$, . . . $G_n$ in more convenient manner can be selected.

Further, by applying the bias reference voltage $V_{ee}$ or the display control signal DISP to respective gate electrodes $G_1$, $G_2$, . . . $G_n$ of the P-type field effect transistors $Q_1$, $Q_2$, . . . $Q_n$, the selective use of the P-type field effect transistors $Q_1$, $Q_2$, . . . $Q_n$ according to the withstanding voltage may be permitted.

Figure 5:
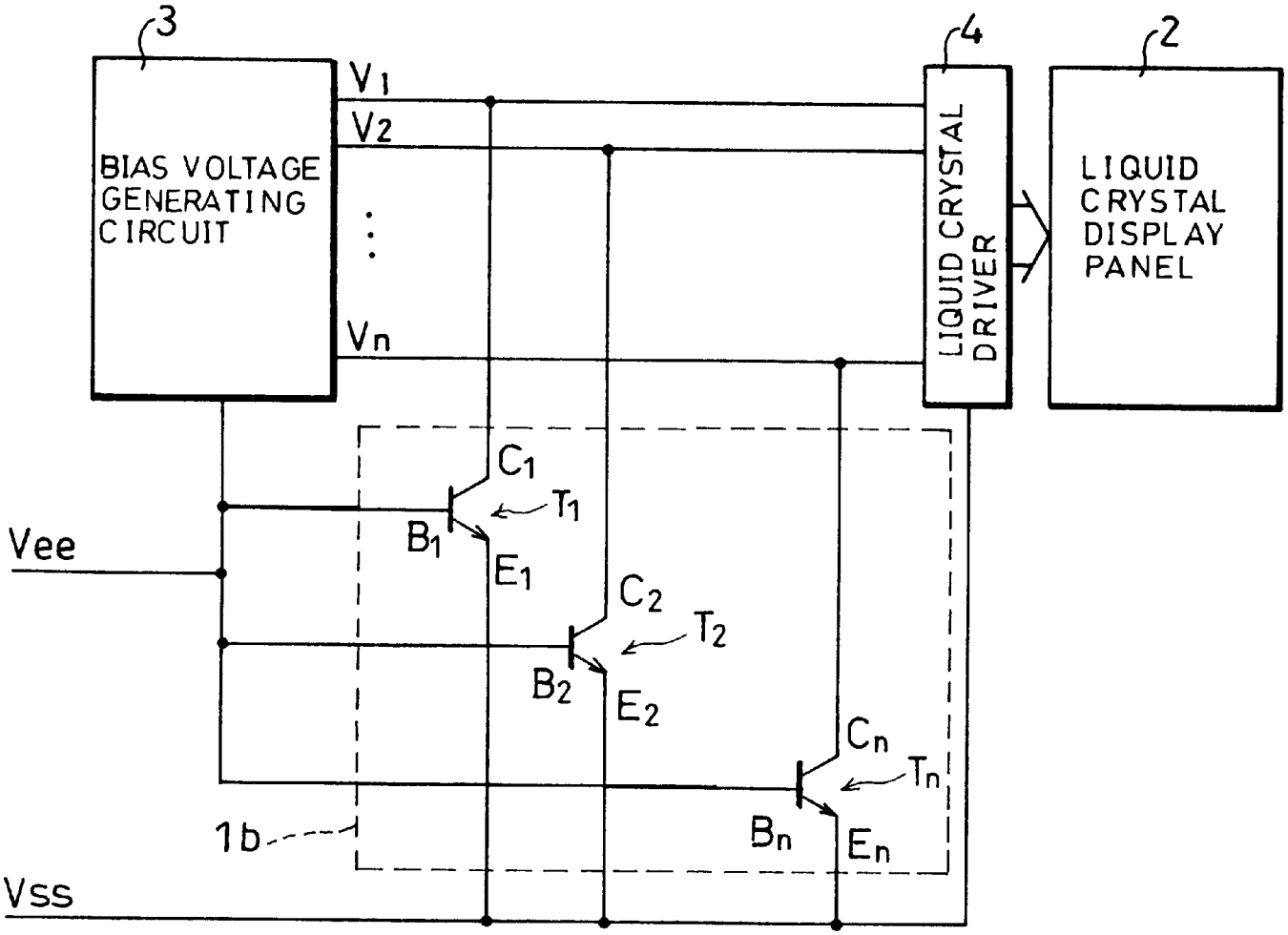
FIG. 5 is an explanatory view illustrating the arrangement where the discharge circuit is constituted by bipolar transistors, and a bias reference voltage is applied to a base of the bipolar transistor.

In the present embodiment, explanations have been given through the case of adopting the discharge circuit 1*a* composed of the P-type field effect transistors $Q_1$, $Q_2$, . . . $Q_n$ in replace of the discharge circuit 1 adopted in the first embodiment. However, other than the discharge circuit 1*a*, for example, as shown in FIG. 5, a discharge circuit 1*b* composed of bipolar transistors $T_1$, $T_2$, . . . $T_n$ having the same characteristics as the P-type field effect transistors $Q_1$, $Q_2$, . . . $Q_n$ may be adopted in replace of the discharge circuit 1.

In this case, collectors $C_1$, $C_2$, . . . $C_n$ of the bipolar transistors $T_1$, $T_2$, . . . $T_n$ are respectively connected to output terminals of the bias voltage generating circuit 3. On the other hand, emitters $E_1$, $E_2$, . . . $E_n$ are respectively connected to a ground potential $V_{ss}$. On the other hand, bases $B_1$, $B_2$, . . . $B_n$ are respectively connected to the bias reference voltage $V_{ee}$ for generating the bias voltages $V_1$, $V_2$, . . . $V_n$. Namely, the bipolar transistors $T_1$, $T_2$, . . . $T_n$ are provided so as to respectively correspond to the bias voltages $V_1$, $V_2$, . . . $V_n$, and the bias voltages $V_1$, $V_2$, . . . $V_n$ are connected to ground via the bipolar transistors $T_1$, $T_2$, . . . $T_n$.

When the power of the apparatus is set in the ON state, as the bias reference voltage $V_{ee}$ is applied to the bases $B_1$, $B_2$, . . . $B_n$ respectively, the bipolar transistor $T_1$, $T_2$, . . . $T_n$ are set in the OFF state by the characteristics thereof. As a result, bias voltages $V_1$, $V_2$, . . . $V_n$ generated by the bias voltage generating circuit 3 are surely applied only to the liquid crystal display panel 2, thereby preventing a waste power consumption by members other than the liquid crystal display panel 2.

On the other hand, when the power of the apparatus is set in the OFF state, as the bias reference voltage $V_{ee}$ is not applied to the bases $B_1$, $B_2$, . . . $B_n$ respectively, the bipolar transistors $T_1$, $T_2$, . . . $T_n$ have predetermined resistors by the characteristics thereof, and are set in the ON state. This permits charges stored on the liquid crystal display panel 2 to be surely removed by discharge in the bipolar transistors $T_1$, $T_2$, . . . $T_n$. As a result, the described arrangement prevents the liquid crystal display panel 2 from being degraded in its quality and appearance.

Figure 6:
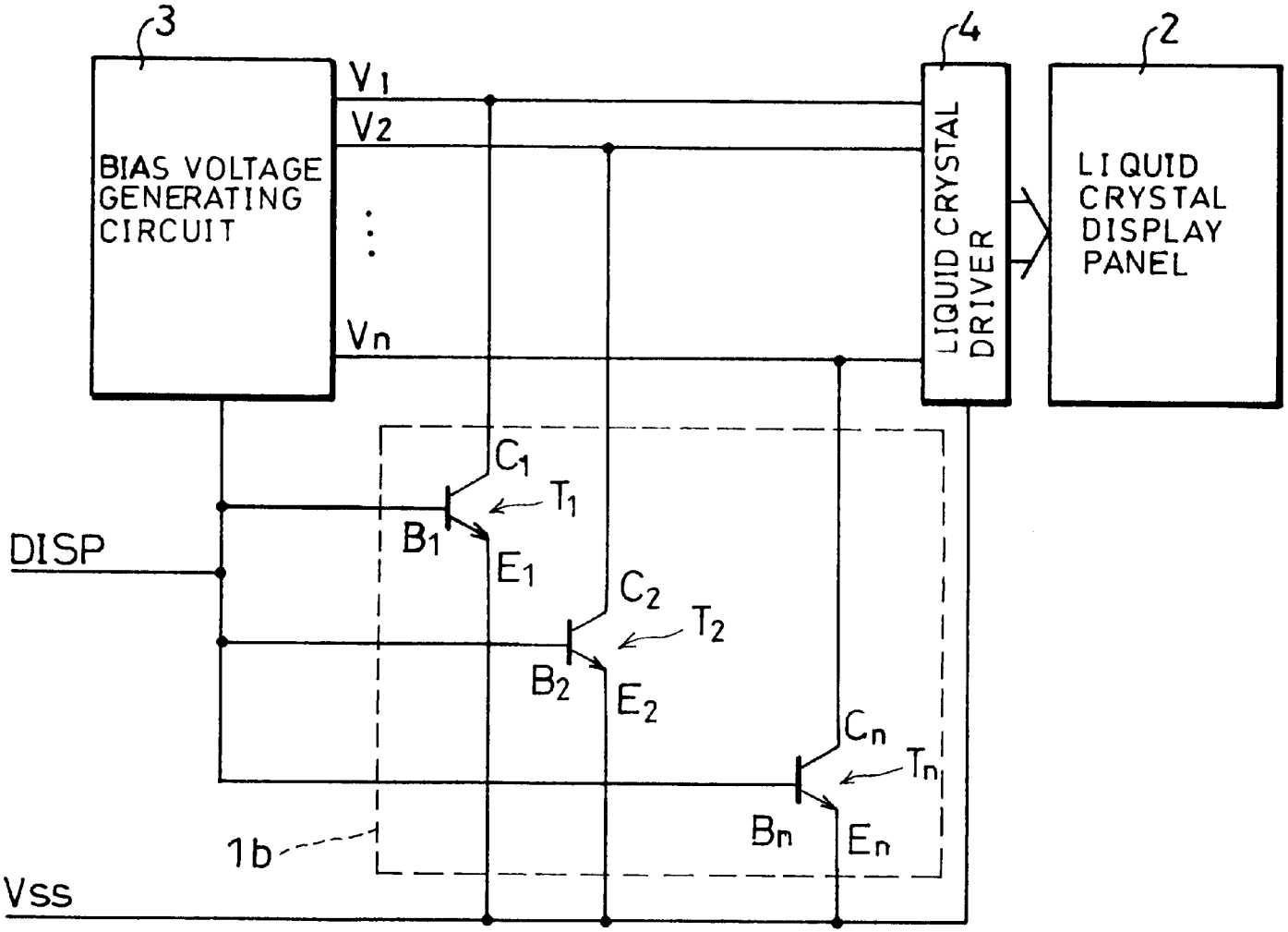
FIG. 6 is an explanatory view illustrating the arrangement where a display control signal is applied to a base of the bipolar transistor.

As shown in FIG. 6, it may be arranged such that the display control signal DISP is inputted instead of the bias reference voltage $V_{ee}$ to the respective bases of the bipolar transistor $T_1$, $T_2$, . . . $T_n$. Needless to mention, this arrangement would offer the same effects as achieved from the aforementioned arrangement.

Figure 7:
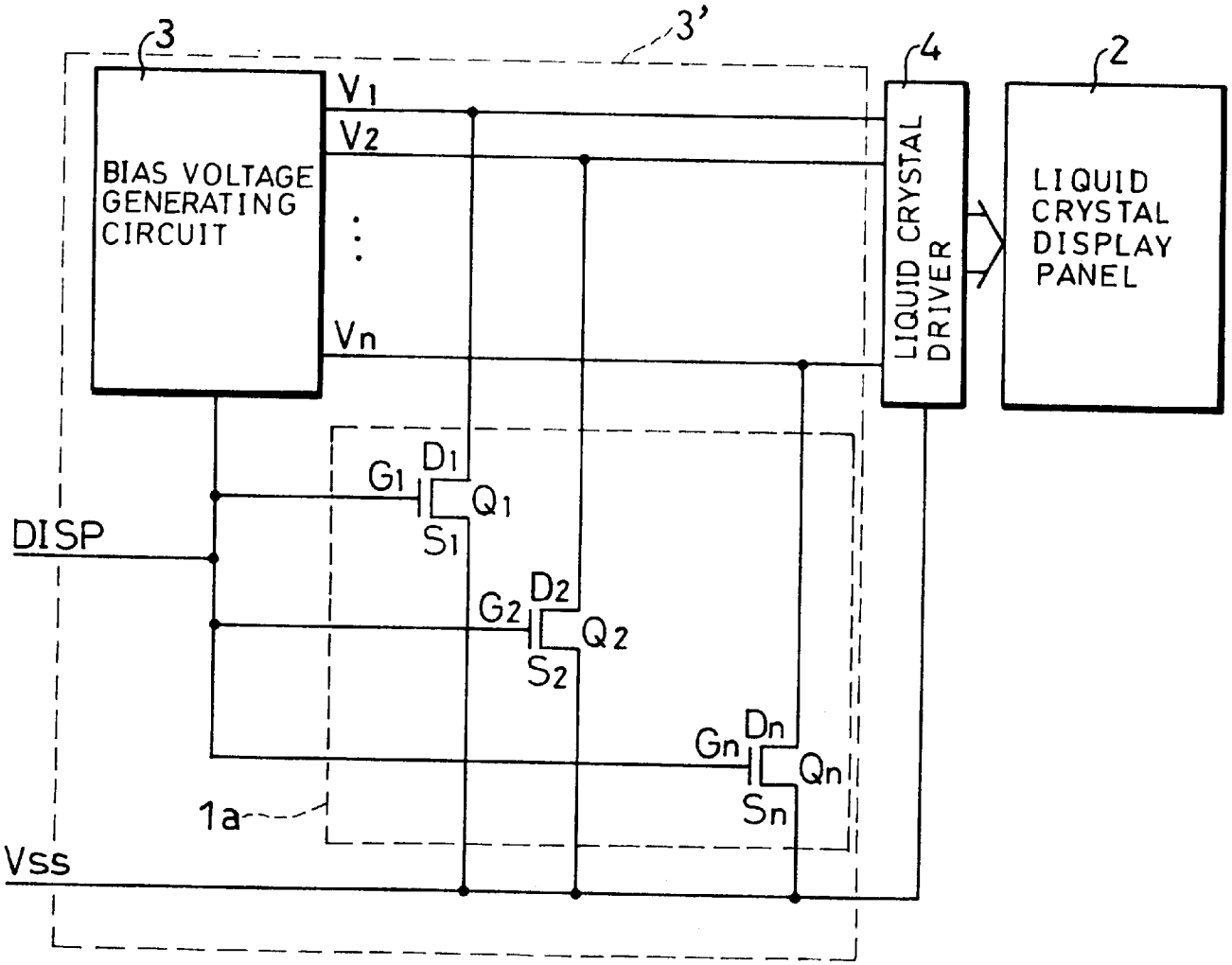
FIG. 7 is an explanatory view illustrating an arrangement where a discharge circuit composed of the P-type field effect transistors and a bias voltage generating circuit are integrally formed.

Additionally, as shown in FIG. 7, by supplying the bias reference voltage $V_{ee}$ or the display control signal DISP to respective bases $B_1$, $B_2$, . . . $B_n$ of the bipolar transistors $T_1$, $T_2$, . . . $T_n$, the collector current as well as the voltage to be applied to the bipolar transistors $T_1$, $T_2$, . . . $T_n$ can be adjusted.

Additionally, a bias voltage generating circuit 3' in which the discharge circuit 1*a* composed of the P-type field effect transistors $Q_1$, $Q_2$, . . . $Q_n$ is incorporated into the bias voltage generating circuit 3 may be adopted.

The generally used bias voltage generating circuit 3 is composed of a bipolar or CMOS (Complementary Metal Oxide Semiconductor). This permits the transistor to be easily incorporated into the bias voltage generating circuit 3. Therefore, by adopting the bias voltage generating circuit 3' in which the discharge circuit 1*a* and the bias voltage generating circuit 3 are integrated by incorporating the P-type field effect transistor $Q_1$, $Q_2$, . . . $Q_n$ into the bias voltage generating circuit 3, a required space for the apparatus can be reduced.

To be more specific, in the arrangement where the bias voltage generating circuit 3 and the discharge circuit 1*a* are separately provided, the measurement shows that the occupied area by these members is 205.3 $mm^2$. On the other hand, when adopting the described bias voltage generating circuit 3' in which the discharge circuit la and the bias voltage generating circuit 3 are integrated, the occupied area by these members, i.e., the occupied area by the bias voltage generating circuit 3' is 108 $mm^2$. This proves that the required space can be saved by adopting the bias voltage generating circuit 3'.

Figure 8:
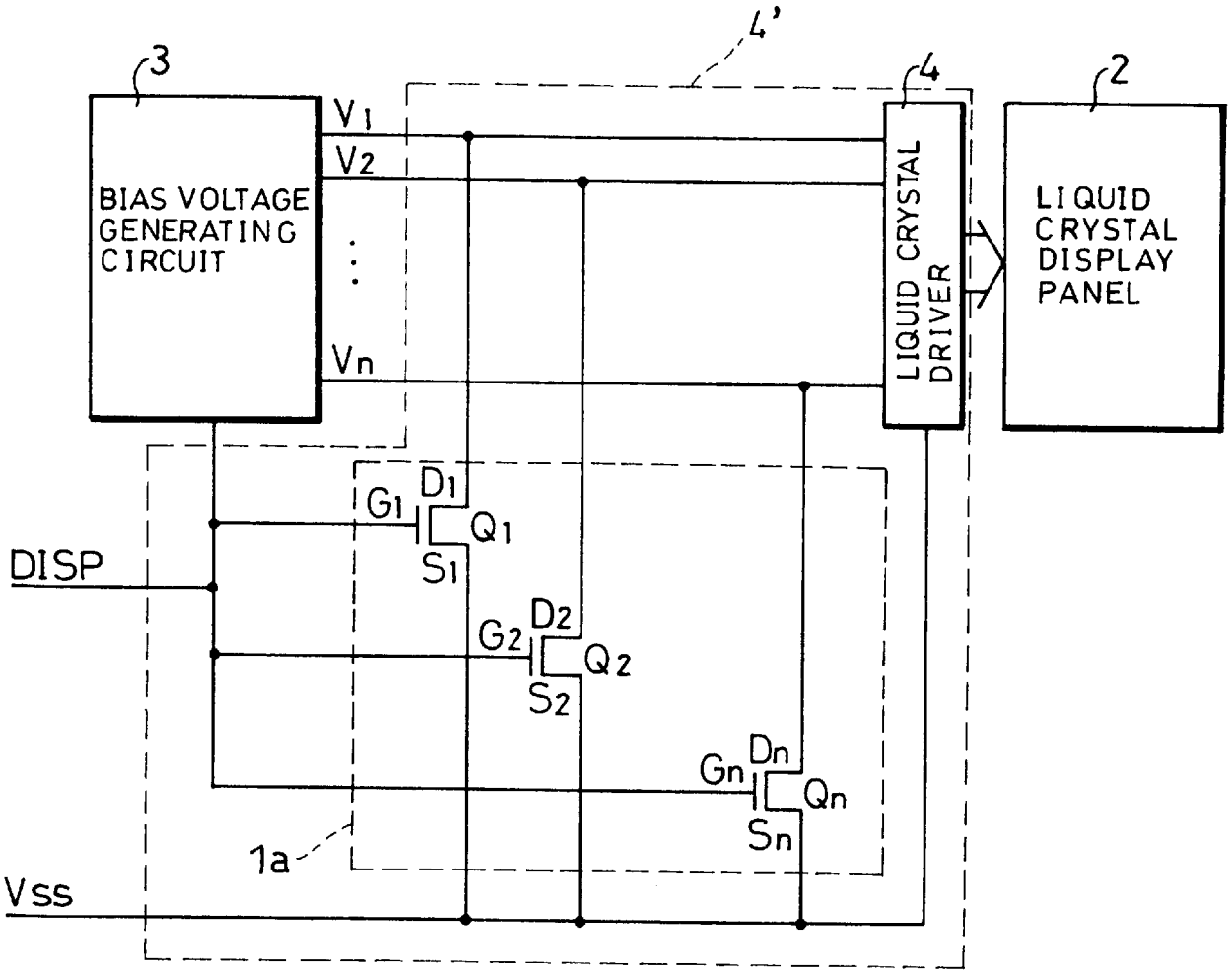
FIG. 8 is an explanatory view illustrating an arrangement where the discharge circuit and a liquid crystal driver are integrally formed.

As shown in FIG. 8, a liquid crystal driver 4' in which the discharge circuit 1*a* composed of the P-type field effect transistors $Q_1$, $Q_2$, . . . $Q_n$ is incorporated into the liquid crystal driver 4 may be adopted.

The liquid crystal driver 4 is arranged such that the segment driver and the common driver to which bias voltages $V_1$, $V_2$, . . . $V_n$ are respectively applied are constituted by the CMOS. This permits the P-type field effect transistors $Q_1$, $Q_2$, . . . $Q_n$ to be easily incorporated into the segment driver and the common driver. Therefore, by incorporating the P-type field effect transistors $Q_1$, $Q_2$, . . . $Q_n$ into the liquid crystal driver 4 to form the liquid crystal driver 4' in which the discharge circuit 1*a* and the liquid crystal driver 4 are integrated, a required space for the apparatus can be reduced.

Figure 9:
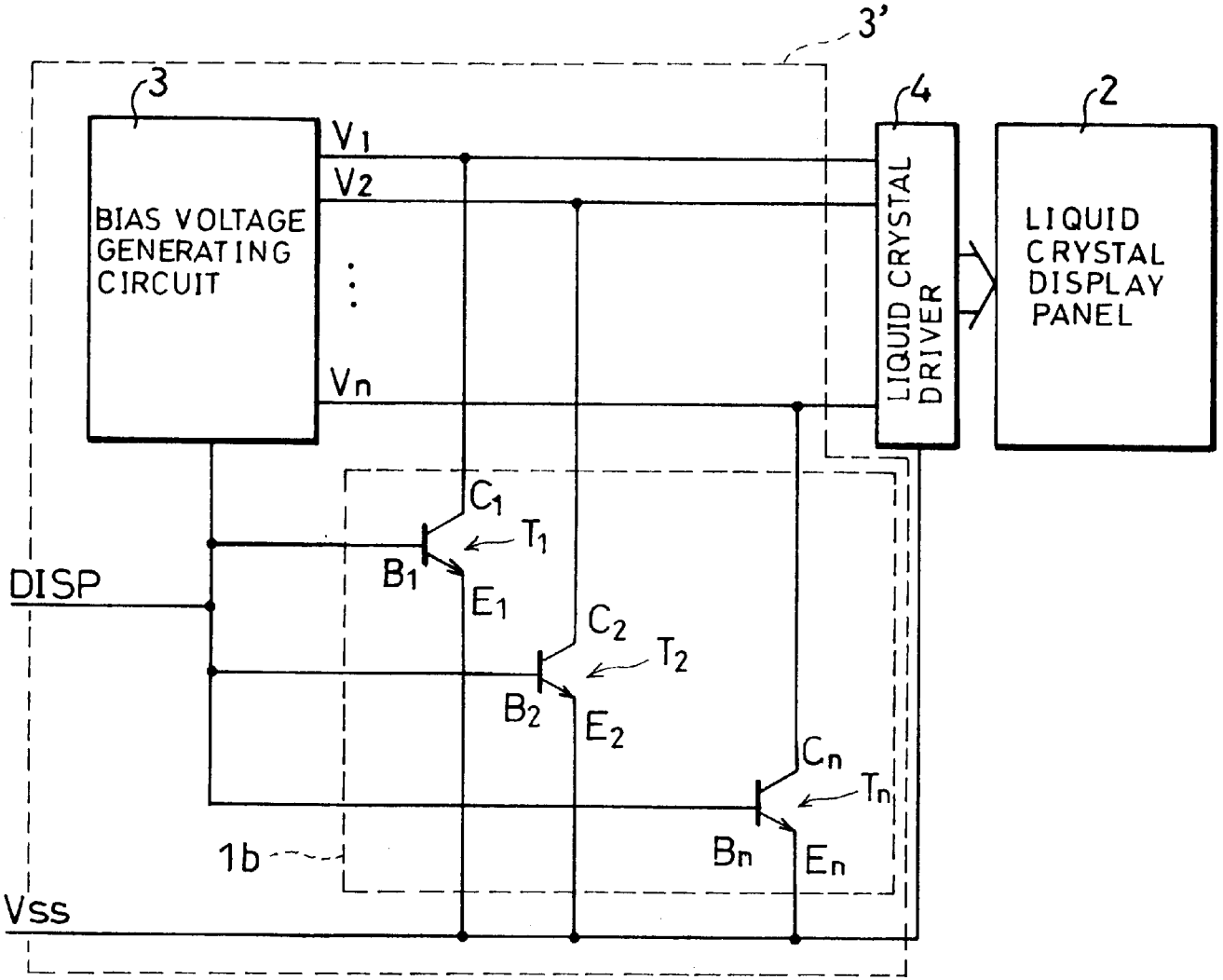
FIG. 9 is an explanatory view illustrating an arrangement where a discharge circuit composed of bipolar transistors, and a bias voltage generating circuit are integrally formed.

As shown in FIG. 9, a bias voltage generating circuit 3' in which the discharge circuit lb composed of the bipolar transistors $T_1$, $T_2$, . . . $T_n$ and the bias voltage generating circuit 3 are integrally formed may be adopted. Needless to say, such arrangement would offer the same effect as achieved by the aforementioned arrangement.

Figure 10:
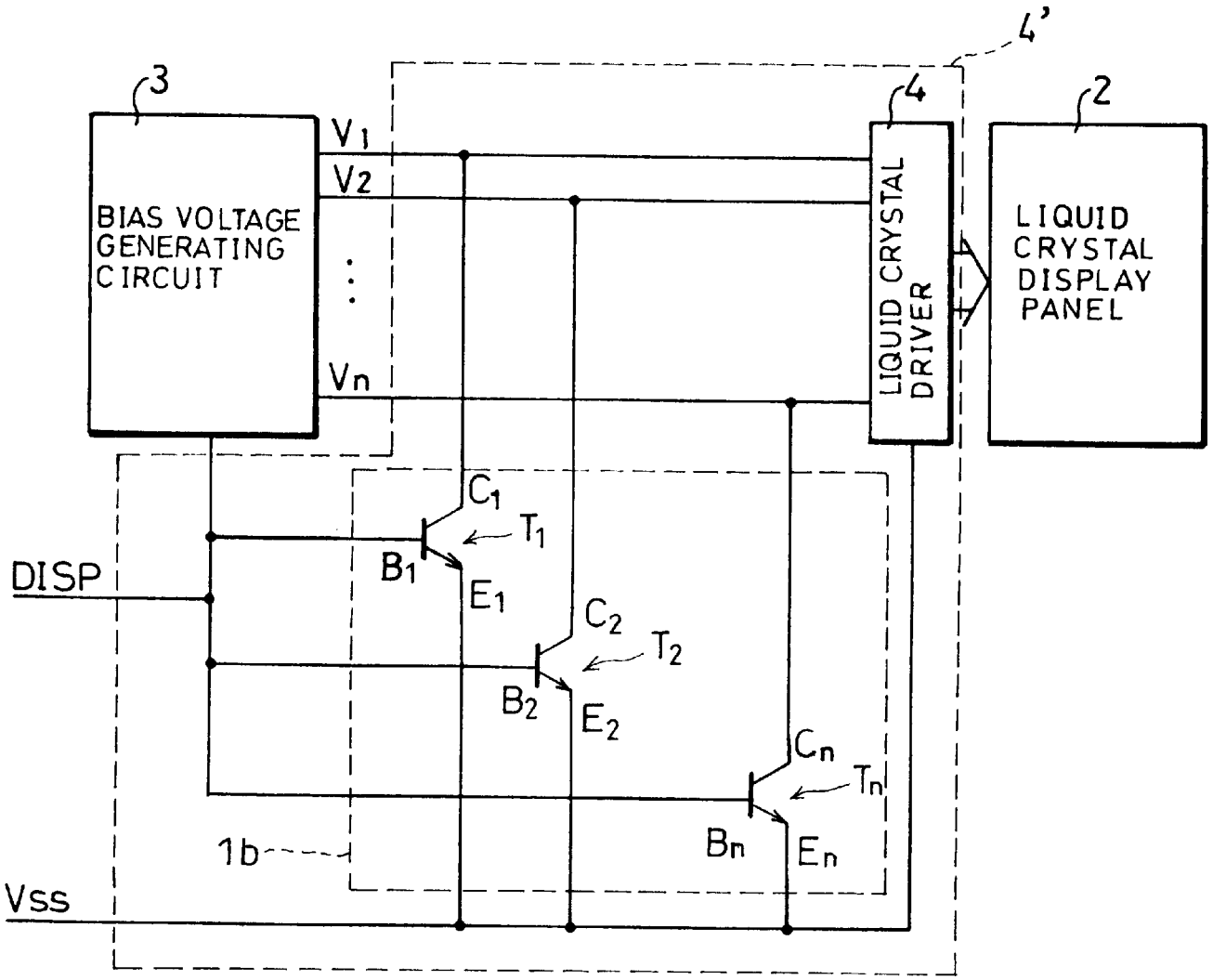
FIG. 10 is an explanatory view illustrating an arrangement where the discharge circuit and a liquid crystal driver are integrally formed.
Figure 11:
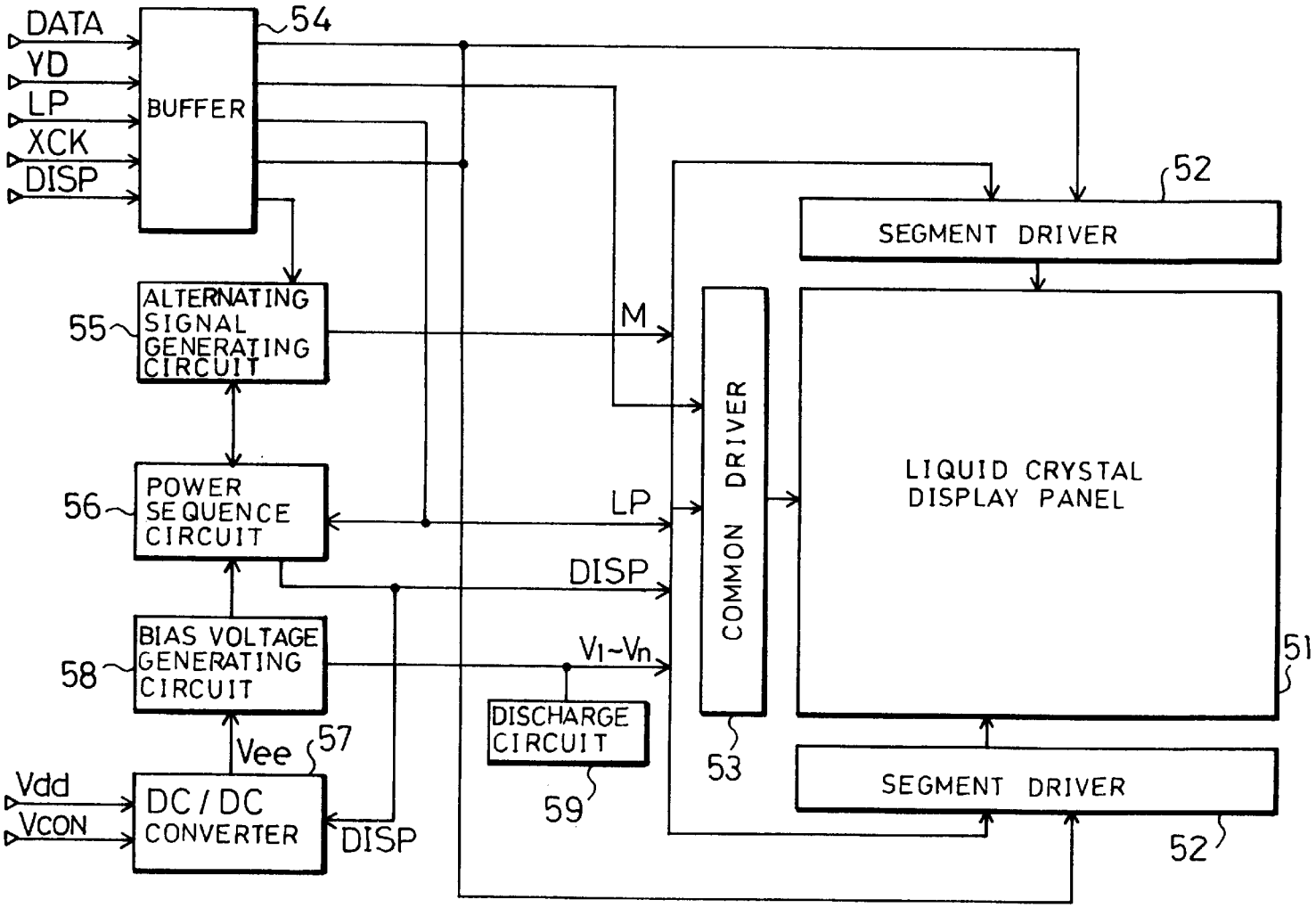
FIG. 11 (PRIOR ART)
FIG. 11 is a block diagram illustrating a schematic structure of a conventional Super Twisted Nematic liquid crystal display apparatus.
Figure 12:
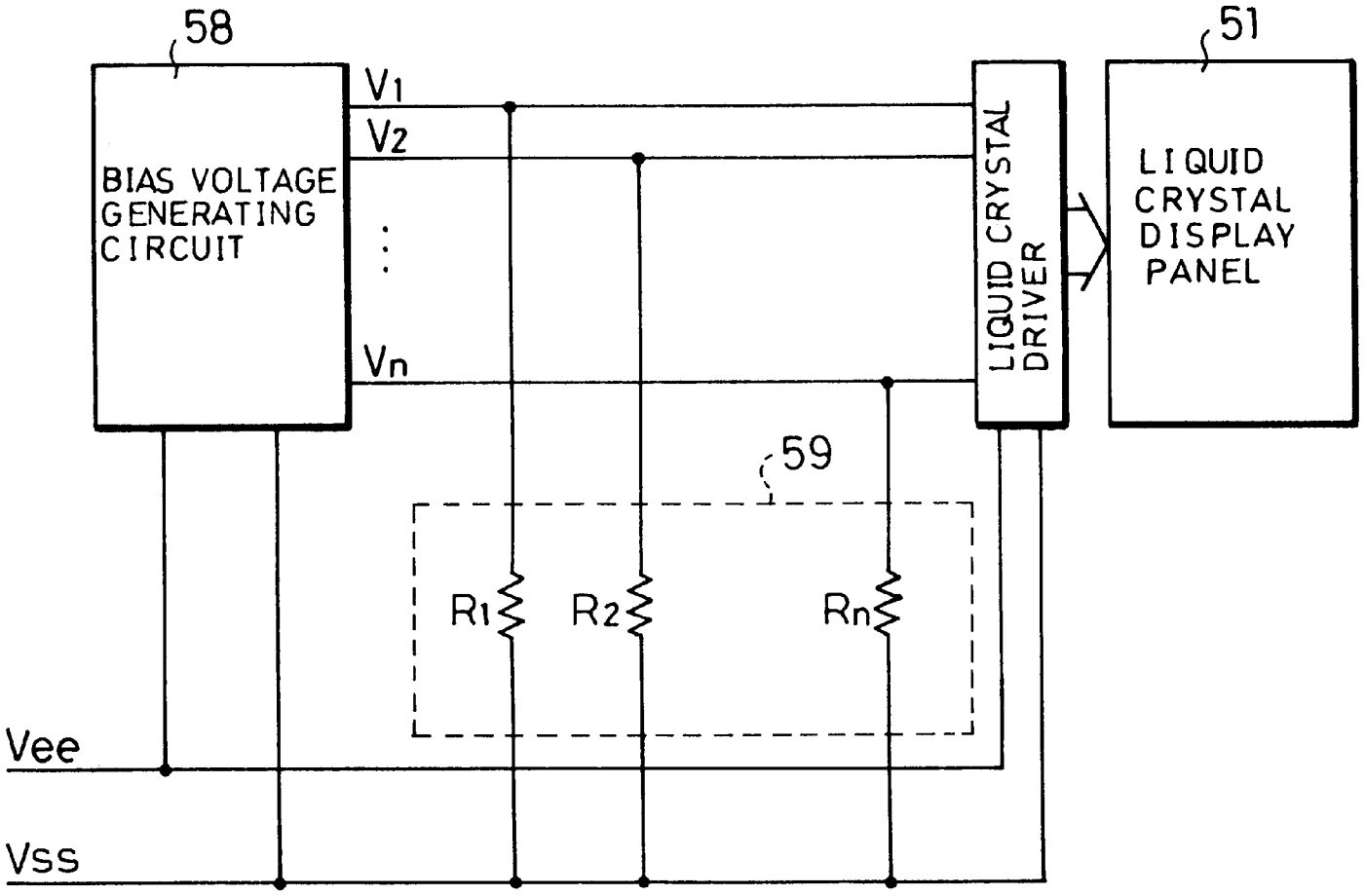
FIG. 12 (PRIOR ART)
FIG. 12 is an explanatory view showing a structure of a discharge circuit of the liquid crystal display apparatus of FIG. 11.
Figure 13:
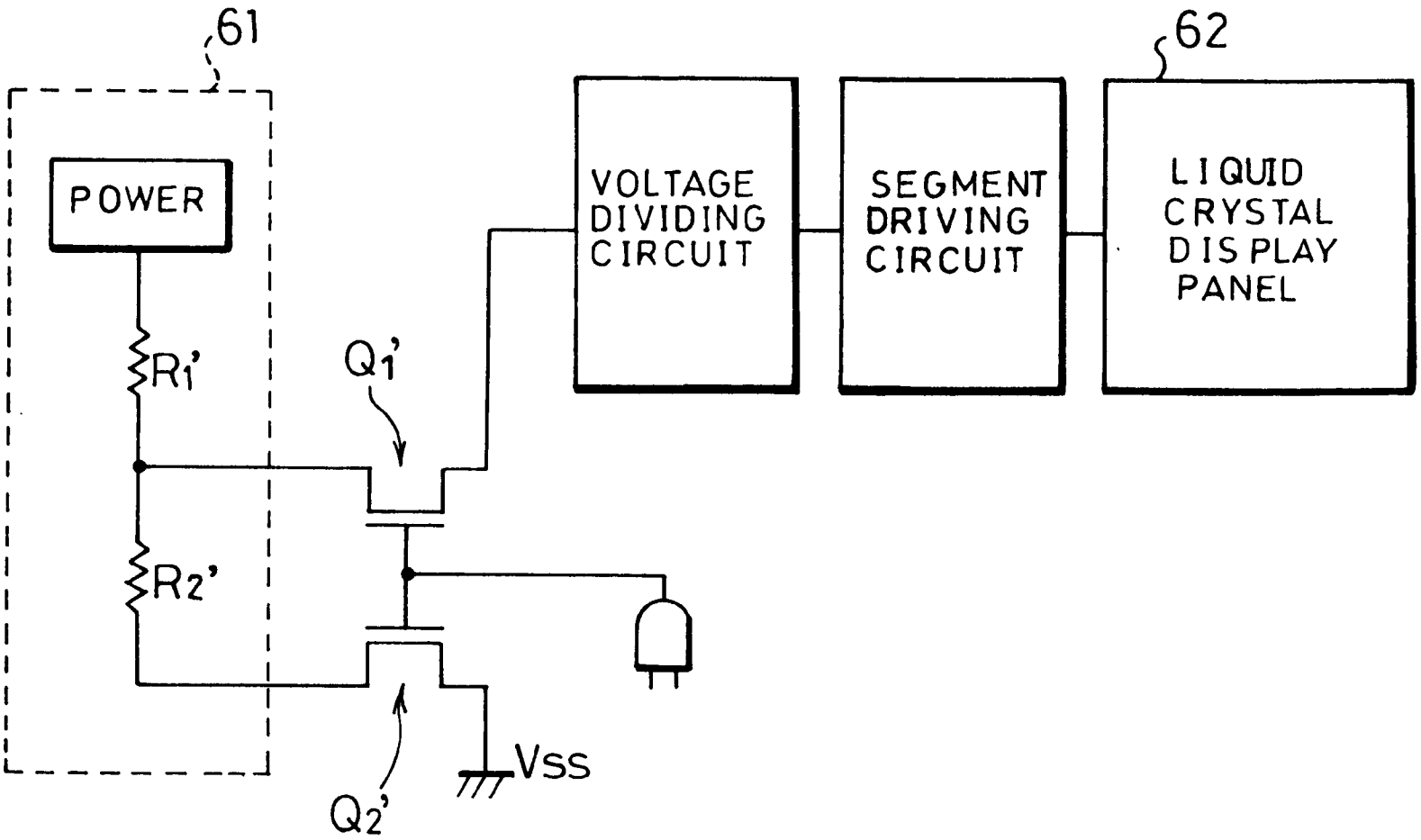
FIG. 13 (PRIOR ART)
FIG. 13 is an explanatory view illustrating a structure of another conventional liquid crystal display apparatus.
Figure 14:
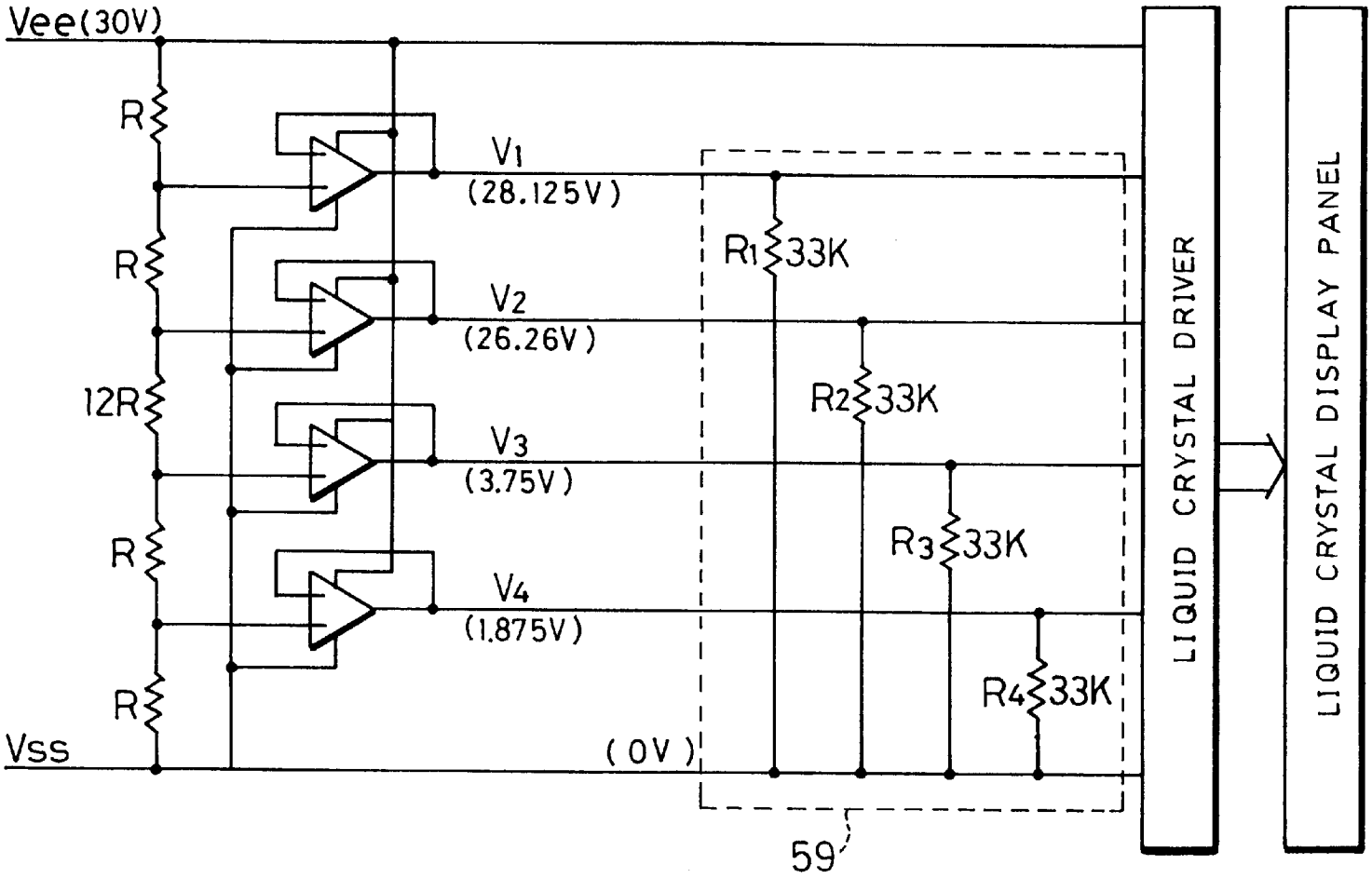
FIG. 14 (PRIOR ART)
FIG. 14 is an explanatory view showing a circuit structure of a conventional generally used liquid crystal display apparatus, in which a bias voltage has four outputs.

Similarly, as shown in FIG. 10, the liquid crystal driver 4' in which the discharge circuit 1*b* composed of the bipolar transistors $T_1$, $T_2$, . . . $T_n$ and the liquid crystal driver 4 are integrally formed may be adopted. Needless to say, such arrangement would offer the same effect as achieved by the aforementioned arrangement.

As described, the arrangement in which the discharge circuits la and lb are respectively incorporated into the bias voltage generating circuit 3 or the liquid crystal driver 4, the same effect of the present invention can be achieved without increasing a cost.

The invention being thus described, it will be understood that the same may be varied in many ways. Such variations are not to be regarded as a departure from the spirit and scope of the invention, and all such modifications as would be apparent to one skilled in the art are intended to be included within the scope of the following claims.

What is claimed is:

1. A liquid crystal display apparatus, comprising:

a liquid crystal display panel;

drive means for driving said liquid crystal display panel;

bias voltage generation means for generating a plurality of bias voltages in accordance with display data, and for supplying said plurality of bias voltages to said drive means to perform a display on said liquid crystal display panel; and discharge means connected to said drive means and to said bias voltage generation means, for discharging charges supplied thereto, wherein said discharge means is comprised only of transistors provided to correspond to respective bias voltages, and each transistor removes charges stored on said liquid crystal display panel by discharge when a power of said apparatus is set in an OFF state, and a display is prohibited, while said bias voltages are supplied only to said liquid crystal display panel when a display is permitted.

2. The liquid crystal display apparatus as set forth in claim 1, wherein:

said transistors are field effect transistors, and each bias voltage is connected to ground via the corresponding field effect transistor.

3. The liquid crystal display apparatus as set forth in claim 2, wherein:

bias reference voltage for generating respective bias voltages is applied to respective gate electrodes of the field effect transistors.

4. The liquid crystal display apparatus as set forth in claim 2, wherein a display control signal for controlling ON/OFF of the liquid crystal display panel is supplied to each gate of said field effect transistor.

5. The liquid crystal display apparatus as set forth in claim 2, wherein:

said discharge means and said bias voltage generation means are integrally formed.

6. The liquid crystal display apparatus as set forth in claim 2, wherein:

said discharge means and said drive means are integrally formed.

7. The liquid crystal display apparatus as set forth in claim 2, wherein:

field effect transistor is a P-type field effect transistor.

8. The liquid crystal display apparatus as set forth in claim 1, wherein:

said transistors are bipolar transistors, and the bias voltages are respectively connected to ground via the corresponding bipolar transistors.

9. The liquid crystal display apparatus as set forth in claim 8, wherein:

bias reference voltage for generating bias voltages is applied to respective bases of the bipolar transistors.

10. The liquid crystal display apparatus as set forth in claim 8, wherein:

a display control signal for controlling ON/OFF of a display of said liquid crystal display panel is supplied to the respective bases of said bipolar transistors.

11. The liquid crystal display apparatus as set forth in claim 8, wherein:

said discharge means and said bias voltage generation means are integrally formed.

12. The liquid crystal display apparatus as set forth in claim 8, wherein:

said discharge means and said drive means are integrally formed.

13. A liquid crystal display apparatus comprising:

a liquid crystal display panel;

a driving circuit for driving said liquid crystal display panel;

a bias voltage generator circuit generating a plurality of bias voltages based on display data, and supplying said plurality of bias voltages to the driving circuit to provide a display on said liquid crystal display panel; and a discharge circuit connected to the drive circuit and to the bias voltage generator circuit to discharge charges supplied to said discharge circuit, said discharge circuit comprising transistors corresponding to respective bias voltages, wherein only the transistors remove charges stored on the liquid crystal display panel when said liquid crystal display apparatus is turned off, and when a display is prohibited, said bias voltages being supplied to said liquid crystal display panel only when display is permitted.

14. A liquid crystal display apparatus comprising:

a liquid crystal display panel;

a driving circuit for driving said liquid crystal display panel;

a generator circuit generating a plurality of bias voltages based on display data, and supplying said plurality of bias voltages to the driving circuit to provide a display on said liquid crystal display panel; and a discharge circuit connected to the drive circuit and to the bias voltage generator circuit to discharge charges supplied to said discharge circuit, said discharge circuit comprising transistors corresponding to respective bias voltages, wherein only the transistors remove charges stored on the liquid crystal display.

15. The liquid crystal display apparatus according to claim 14, wherein said transistors are field effect transistors.

16. The liquid crystal display apparatus according to claim 15, wherein each bias voltage is connected to ground via a corresponding field effect transistor.

17. The liquid crystal display apparatus according to claim 15, wherein the field effect transistors are P-type field effect transistors.

18. The liquid crystal display apparatus according to claim 14, wherein said transistors are bipolar transistors.

19. The liquid crystal display apparatus according to claim 18, wherein each bias voltage is connected to ground via a corresponding bipolar transistor.

* * * * *